US005836769A

United States Patent [19]

Spencer

[11] Patent Number: 5,836,769

[45] Date of Patent: Nov. 17, 1998

[54] TOOTHBRUSH, METHOD OF MAKING A TOOTHBRUSH, AND METHOD OF BRUSHING TEETH

[75] Inventor: Jean L. Spencer, Boston, Mass.

[73] Assignee: Gillette Canada Inc., Kirkland, Canada

[21] Appl. No.: 753,927

[22] Filed: Dec. 3, 1996

[51] Int. Cl.[6] ..... A61C 15/00

[52] U.S. Cl. ..... 433/216; 401/132; 401/268; 15/167.1; 15/207.2

[58] Field of Search ..... 433/215, 216; 132/308; 401/132, 268; 300/21; 15/104.94, 167.1, 207.2

[56] References Cited

U.S. PATENT DOCUMENTS

| | | | |
|---|---|---|---|
| Re. 21,197 | 9/1939 | Hill et al. | 300/21 |
| 1,238,883 | 9/1917 | Burlew . | |
| 1,637,153 | 7/1927 | Lawton . | |
| 2,099,688 | 11/1937 | Hill et al. | 300/21 |
| 3,378,870 | 4/1968 | Matsunaga | 15/104.94 |
| 3,917,420 | 11/1975 | Watson | 401/286 |
| 4,030,845 | 6/1977 | Deckert | 401/268 |
| 4,571,768 | 2/1986 | Kawashima | 15/167 R |
| 4,802,255 | 2/1989 | Breuer et al. | 401/268 X |
| 5,061,106 | 10/1991 | Kent | 401/268 |
| 5,242,235 | 9/1993 | Li | 401/268 |
| 5,276,935 | 1/1994 | Lemon et al. | 15/104.94 |
| 5,300,290 | 4/1994 | Spencer | 424/54 |
| 5,373,599 | 12/1994 | Lemon et al. | 15/104.94 |
| 5,403,578 | 4/1995 | Gordon | 424/53 |
| 5,538,353 | 7/1996 | De Harilland | 401/132 |

FOREIGN PATENT DOCUMENTS

| | | |
|---|---|---|
| 0 663 162 | 7/1995 | European Pat. Off. . |
| 2 622 779 | 5/1989 | France . |
| 88-215459 | 12/1986 | Japan . |

*Primary Examiner*—Nicholas D. Lucchesi
*Attorney, Agent, or Firm*—Fish & Richardson P.C.

[57] ABSTRACT

A method of manufacturing a toothbrush, including providing a bristle having a first opening, a second opening, and a lumen between the first and the second openings; contacting the first opening with a substance; applying a vacuum to the second opening thereby suctioning the substance into the lumen through the first opening to provide a bristle containing a substance; and attaching the bristle containing the substance to a toothbrush. A toothbrush including a plurality of bristles having fracturable walls for controllably releasing a substance from the bristles into the oral cavity is provided.

39 Claims, 1 Drawing Sheet

TOOTHBRUSH, METHOD OF MAKING A TOOTHBRUSH, AND METHOD OF BRUSHING TEETH

BACKGROUND OF THE INVENTION

The invention relates to oral hygiene.

Over the years efforts have been made to decrease tooth decay and periodontal disease caused by the presence of bacteria in the mouth. Fighting gum disease, in particular, has been the focus of people in the health care fields. Efforts in these areas have included developments in devices, compositions, and techniques for brushing and flossing teeth, and introducing bacteria-fighting compounds into the mouth. These efforts have included devices for applying compounds to toothbrush bristles. Antimicrobial agents are commonly used to fight bacteria, but they can have negative side effects. Chlorhexidine, in particular, has been used extensively to fight gum disease because of its proven importance and efficacy in this area. Application of large amounts of chlorhexidine to the oral cavity in general, however, imparts an unpleasant taste and can cause teeth to yellow, which is cosmetically undesirable. To avoid these negative side effects, various approaches have been developed for applying smaller amounts of antimicrobial agents directly to sites of importance namely the teeth and gums.

SUMMARY OF THE INVENTION

In general, the invention features a method of manufacturing a toothbrush, including providing a bristle having a first opening, a second opening, and a lumen between the first and the second openings; contacting the first opening with a substance; applying a vacuum to the second opening thereby suctioning the substance into the lumen through the first opening to provide a bristle containing a substance; and attaching the bristle containing the substance to a toothbrush.

In preferred embodiments, the method includes preparing a plurality of bristles containing the substance and attaching the bristles to a toothbrush. The bristles include a plurality of lumens between the first and second openings. The bristles preferably include fracturable walls that fracture gradually over a period of brushing.

In one preferred embodiment, the substance is dissolved in a solvent to provide a solution and the first opening is contacted with the solution. The substance may also be dispersed in a liquid. Preferably the substance is a therapeutic agent (e.g. chlorhexidine). Additionally, the substance may include a non-therapeutic agent (e.g., a binder, a pigment, or a dye). The method includes evaporating the liquid from the lumen. The method may also include crystallizing the substance in the lumen prior to evaporating the liquid from the lumen.

In another aspect, the invention features a method of applying a substance to teeth including brushing the teeth with a toothbrush having a plurality of bristles. The bristles have fracturable walls defining multiple lumens containing the substance. The walls fracture during brushing and release the substance to the teeth. Preferably the bristles are configured to release the substance in a controlled manner during brushing and may include double lumen and trilocular bristles.

In another aspect, the invention features a toothbrush including a plurality of bristles having fracturable walls defining multiple lumens containing a substance. The walls are constructed to fracture during brushing thereby releasing the substance to the teeth.

The invention provides a method for incorporating a substance into a hollow bristle. It provides an approach for simultaneously incorporating the substance into the lumens in a plurality of hollow bristles. Significantly, contamination of the exterior walls of the bristles with the substance can be avoided using the method. Moreover, the toothbrush can be used to deliver small amounts of therapeutic agents to the mouth over an extended period of time, i.e., effecting a controlled release of the substance. The substance within the lumen can exist in a solid, e.g., crystal state, as opposed to being in solution, which may decrease the propensity of the substance to degrade.

Other features and advantages of the invention will be apparent from the following description of the preferred embodiments thereof, and from the claims.

DESCRIPTION OF THE PREFERRED EMBODIMENTS

Figure 2:
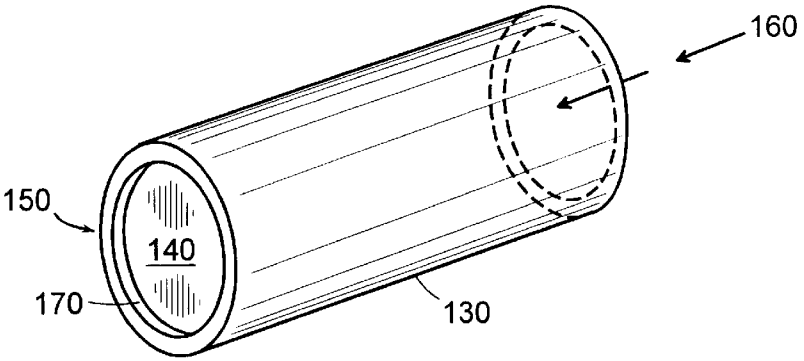
FIG. 2 is a perspective view of a toothbrush bristle.
Figure 3:
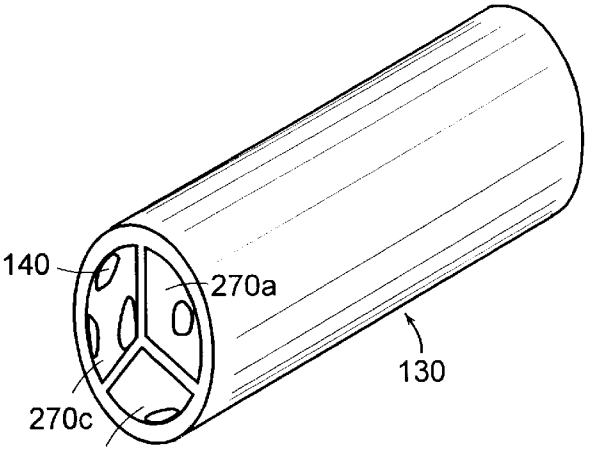
FIG. 3 is a perspective view of a trilocular toothbrush bristle.
Figure 1:
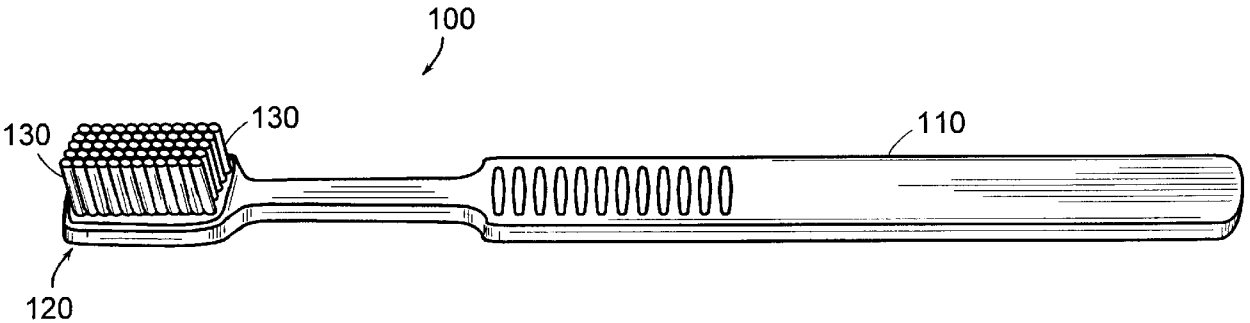
FIG. 1 is a side view of a toothbrush of the present invention.

Referring to FIGS. 1 and 2, toothbrush 100 includes a handle end 110, and a brush end 120 having a plurality of bristles 130 containing a substance 140. Each bristle 130 has openings 150 and 160, and at least one lumen 170 extending between the openings. Referring to FIG. 3, bristle 130 is trilocular, i.e., it has three lumens 270*a*, 270*b* and 270*c*.

The walls of bristle 130 are designed to break down gradually during brushing of the teeth or gums so as to control the rate of release of substance 140. The walls will generally break down by fracturing or splitting. The fracturable walls facilitate the gradual release of the substance contained within each lumen by providing paths by which the substance can leave the lumen. In addition, the fractures enable the liquids in the mouth to more easily access the substance and act as a carrier for the substance (e.g. by solubilizing the substance), which also facilitates the transfer of the substance from the lumens to the mouth.

The intended application of the bristles 130 and desired rate of release of substance 140 will influence the desired rate of wall fracture. For example, if rapid application of a substance is desired, the bristles selected will be those bristles that have been constructed to break down rapidly during brushing. A number of factors influence the propensity of the bristle walls to fracture including bristle composition, wall thickness, the number of lumens, the diameter or cross-sectional size of the lumens, and the bristle shape. Accordingly, the rate of release of the substance to the oral surfaces can be controlled or altered by incorporating a variety of bristles having differing rates of fracture into a single toothbrush, e.g., incorporating one, two, three, and four lumen bristles and combinations thereof in a single toothbrush.

Bristles 130 can be constructed from polymeric materials having characteristics suitable for producing bristles with fracturable walls. Examples of such suitable polymeric materials include polyolefins (e.g., polyethylene and polypropylene), polyamides (e.g., nylon and polythalamide), polyesters (e.g., PBT and PET), fluoropolymers (e.g., PVDF), polyacrylates, polysulfones, acetyl resins, and combinations thereof. Other suitable polymeric materials include thermoplastic elastomers such as polyetheramides (e.g., Pebax), polyurethanes (e.g., Pellethane), polyolefin elastomers (e.g., Santoprene), styrene-ethylene-butylene-styrene block copolymers, styrene-butadiene-styrene block copolymers, styrene-isoprene-styrene block copolymers (e.g., Kraton rubbers), and combinations thereof. The bristles may each include a blend of these polymers to form a single phase or separate phases coextruded in various configurations, e.g., a trilocular (i.e., a three lumen) bristle with a central spine of one material and an outer annular wall of another material. Preferred bristles are made of nylon 612, e.g., those sold by DuPont under the tradenames Tynex trilocular filaments, and Tynex tetralocular filaments. These polymeric materials may contain fillers and additives to provide strength, lubricity, texture, abrasiveness, and color to the bristles. Examples of suitable fillers and additives include, kaolin, PTFE, titanium dioxide, and the like.

The bristles may have diameters ranging from about 3 to about 150 mil (about 0.076 to about 3.81 mm), preferably about 3 to about 15 mil (0.381 mm). These bristles may be cut to a desired length for use in a toothbrush.

Substance 140 is incorporated into the lumens by contacting opening 150 with substance 140, and applying a vacuum to opening 160. Opening 150 can be placed directly into the substance, or the substance can be directed into opening 150 by, e.g., placing the substance on top of a filtering device such as, e.g., a Buchner funnel, and tightly securing opening 150 near the stem of the funnel. The vacuum can be applied, for example, by attaching the vacuum directly to opening 160, or by suspending opening 160 in a vacuum flask and applying the vacuum to the side arm. Preferably the vacuum is applied simultaneously to a plurality of bristles. Such a plurality of bristles is commonly referred to as a hank, which may be about 4.0 to about 5.5 cm in diameter and up to 120 cm in length.

The vacuum pulls the substance through each lumen 170 and is applied for a period sufficient to fill the lumens to a desired height or length. The vacuum suctions the substance through the lumens but does not pull the substance up along the length of the outer surface of the bristle. Therefore, the process cleanly and efficiently applies a substance to the lumens while avoiding a messy application of the substance on the outer surface of the bristles. The process limits the waste that might occur if the substance was deposited on the outside of the bristle, and provides greater control over the amount of substance applied to the bristle. When the vacuum is removed from opening 160 substance 140 remains within lumens 170.

Substance 140 may be any substance or combination of substances suitable for use in the mouth. Preferred substances include compounds such as therapeutic agents, e.g., anticaries agents, antiplaque agents, antigingivitis agents, antiviral agents, antiinflammatory agents, anticalculus agents, deodorizing agents, desensitizing agents, sealants, and remineralizing agents, and non-therapeutic agents, e.g., surfactants, binders, abrasives, whitening agents, pigments, dyes, and flavors. Examples of suitable substances include sodium fluoride, stannous fluoride, sodium monofluorophosphate, chlorhexidine, chlorhexidine salts, tetracycline, cetylpyridinium chloride, triclosan, tetrasodium pyrophosphate, disodium dihydrogen pyrophosphate, zinc chloride, zinc citrate, strontium chloride, calcium oxalate, potassium nitrate, eucalyptol, menthol, thymol, sodium lauryl sulfate, polyoxyethylene sorbitan fatty acid esters, polyacrylates, carrageenan, carboxymethyl cellulose, silica, alumina, calcium phosphates, peroxides, peppermint, cinnamon, FD&C Blue #2, FD&C Blue #2 Lake.

The substance may also include binders to provide bulk and viscosity to the substance. Examples of suitable binders include synthetic organic polymers (e.g., Carbopol resins), inorganic compounds (e.g., silica powders), modified cellulose compounds (e.g., carboxymethyl cellulose and hydroxyethyl cellulose), natural vegetable gums (e.g., carrageenan and sodium alginate), and gums of bacterial origin (e.g., xanthan gum).

Substance 140 can be in any form that will allow the substance to be placed in and remain within the lumens of the bristle. Such forms include solutions, dispersions, microemulsions, gels, pastes, and powders. In addition, the substance may be adsorbed onto the outer surface of microparticles, e.g., polystyrene microparticles or degradable microparticles, as described, for example, in U.S. Pat. No. 5,300,290 and pending application Ser. No. 08/322,926 incorporated herein by reference, or encapsulated within microcapsules, as described in U.S. Pat. No. 5,403,578.

In a preferred embodiment, substance 140 is in a liquid, e.g., dissolved in a solvent to provide a solution or dispersed in a liquid to provide a dispersion or emulsion. The liquid containing substance 140 is then suctioned through lumen 170 by the vacuum. When lumen 170 is filled to the desired level, the vacuum is removed and the liquid is evaporated out of lumen 170 leaving behind substance 140 in lumen 170. The liquid can be evaporated, for example, by placing bristles 130 on a surface until the liquid evaporates, or by subjecting the bristles 130 to a heat source, e.g., placing the bristles in an oven. Alternatively, after the bristles are filled with the liquid, they are exposed to a temperature that is low enough to cause substance 140 to crystallize, after which the liquid is evaporated.

Bristles 130 are then attached to toothbrush 100 using methods well known by those skilled in the art. An example of one such method is described in U.S. Pat. No. 3,230,015. Typically the bristle will be trimmed to a desired length after being attached to a toothbrush.

In an alternative embodiment, a pigment or a dye is included with substance 140. During the steps of filling lumen 170 the pigment functions as a visual indicator of the distance along lumen 170 that the substance has been pulled by the vacuum. In addition, the pigment provides a visual indication to a user of toothbrush 100 as to the presence or absence of a substance in the toothbrush and the degree of wear of the bristles.

The substance is then applied to the teeth by brushing the teeth with the toothbrush. The brushing action causes the walls of the bristle to break down thereby releasing the substance to the teeth and gums. The fractures also provide a means through which the liquids in the mouth can gain access to the substance, solubilize it, and carry it to the oral surfaces.

Other embodiments are within the claims. For example, the bristles can be double lumen, trilocular (i.e., three lumen), and tetralocular (i.e., four lumen). The lumen diameter and the number of lumens in each bristle on the toothbrush may also vary. For example, the brush may contain a combination of one or more single lumen, double lumen, trilocular, tetralocular, and solid bristles. The bristles may have outer walls defining various shapes including, e.g., lobular, annular, or, alternatively, polygonal outer walls, i.e., the outer walls of the bristles may form the shape of a triangle, a square, a rectangle, a hexagon, or a diamond.

What is claimed is:

1. A method of manufacturing a toothbrush, comprising:

providing a bristle comprising a first opening, a second opening, and a lumen between said first opening and said second opening;

contacting said first opening with a substance;

applying a vacuum to said second opening thereby suctioning said substance into said lumen through said first opening to provide a bristle containing said substance; and attaching said bristle containing said substance to a toothbrush.

2. The method of claim 1, wherein a plurality of said bristles containing said substance are made and attached to said toothbrush.

3. The method of claim 1, wherein said bristle further comprises fracturable walls.

4. The method of claim 3, wherein said fracturable walls fracture gradually over a period of brushing.

5. The method of claim 1, wherein said bristle further comprises a plurality of lumens between said first opening and said second opening.

6. The method of claim 1, wherein said substance is dissolved in a solvent to provide a solution and wherein said first opening is contacted with said solution.

7. The method of claim 6, further comprising evaporating said solvent from said solution in said lumen.

8. The method of claim 6, further comprising crystallizing said substance in said lumen containing said substance, and evaporating said solvent from said lumen.

9. The method of claim 1, wherein said substance is dispersed in a liquid and wherein said first opening is contacted with said liquid.

10. The method of claim 1, wherein said substance comprises a therapeutic agent.

11. The method of claim 1 wherein said substance comprises chlorhexidine.

12. The method of claim 1, wherein said substance comprises a non-therapeutic agent.

13. The method of claim 1, wherein said substance comprises a binder.

14. The method of claim 1, wherein said substance comprises a pigment or a dye.

15. The method of claim 1, wherein said bristles comprise double lumen bristles.

16. The method of claim 1, wherein said bristles comprise trilocular bristles.

17. The method of claim 1, wherein said substance comprises a paste.

18. The method of claim 1, wherein said substance comprises a gel.

19. A method of applying a substance to teeth, comprising:

brushing said teeth with a toothbrush comprising a plurality of bristles, said bristles each comprising fracturable walls defining multiple lumens containing said substance, said walls fracturing during brushing:and releasing said substance, to said teeth.

20. The method of claim 19, wherein said substance comprises a therapeutic agent.

21. The method of claim 19, wherein said substance comprises chlorhexidine.

22. The method of claim 19, wherein said bristles are configured to release said substance in a controlled manner during brushing.

23. The method of claim 19, wherein said bristles comprise double lumen and trilocular bristles.

24. The method of claim 19, wherein said bristles comprise double lumen bristles.

25. The method of claim 19, wherein said bristles comprise trilocular bristles.

26. The method of claim 19, wherein said substance comprises a paste.

27. The method of claim 19, wherein said substance comprises a gel.

28. A toothbrush, comprising:

a plurality of bristles each comprising fracturable walls defining multiple lumens containing a substance, said walls constructed to fracture during brushing thereby releasing said substance.

29. The toothbrush of claim 28, wherein said bristles are configured to release said substance in a controlled manner during brushing.

30. The toothbrush of claim 28, wherein said bristles comprise double lumen and trilocular bristles.

31. The toothbrush of claim 28, wherein said substance comprises a therapeutic agent.

32. The toothbrush of claim 28, wherein said substance comprises chlorhexidine.

33. The toothbrush of claim 28, wherein said substance comprises a non-therapeutic agent.

34. The toothbrush of claim 28, wherein said substance comprises a binder.

35. The toothbrush of claim 28, wherein said substance comprises a pigment or a dye.

36. The toothbrush of claim 28, wherein said bristles comprise double lumen bristles.

37. The toothbrush of claim 28, wherein said bristles comprise trilocular bristles.

38. The toothbrush of claim 28, wherein said substance comprises a paste.

39. The toothbrush of claim 28, wherein said substance comprises a gel.

* * * * *